US009787031B2

(12) United States Patent
Ludwig et al.

(10) Patent No.: US 9,787,031 B2
(45) Date of Patent: Oct. 10, 2017

(54) ELECTRICAL CONNECTOR WITH ADJUSTED IMPEDANCE

(71) Applicant: DELPHI TECHNOLOGIES, INC., Troy, MI (US)

(72) Inventors: Martin Ludwig, Wuppertal (DE); Michael Rucks, Schwerte (DE)

(73) Assignee: DELPHI TECHNOLOGIES, INC., Troy, MI (US)

( * ) Notice: Subject to any disclaimer, the term of this patent is extended or adjusted under 35 U.S.C. 154(b) by 0 days.

(21) Appl. No.: 15/208,841

(22) Filed: Jul. 13, 2016

(65) Prior Publication Data

US 2017/0025796 A1 Jan. 26, 2017

(30) Foreign Application Priority Data

Jul. 21, 2015 (EP) ..... 15177597

(51) Int. Cl.

| | |
|---|---|
| ***H01R 13/6474*** | (2011.01) |
| ***H01R 13/58*** | (2006.01) |
| ***H01R 13/506*** | (2006.01) |
| ***H01R 13/6473*** | (2011.01) |
| ***H01R 43/04*** | (2006.01) |
| ***H01R 43/26*** | (2006.01) |
| *H01R 4/18* | (2006.01) |
| *H01R 13/639* | (2006.01) |

(52) U.S. Cl.

CPC ..... *H01R 13/6474* (2013.01); *H01R 13/506* (2013.01); *H01R 13/5808* (2013.01); *H01R 13/6473* (2013.01); *H01R 43/04* (2013.01); *H01R 43/26* (2013.01); *H01R 4/188* (2013.01); *H01R 13/639* (2013.01)

(58) Field of Classification Search

CPC ..... H01R 13/6474; H01R 13/5808; H01R 43/04; H01R 43/26

See application file for complete search history.

(56) References Cited

U.S. PATENT DOCUMENTS

| | | | | |
|---|---|---|---|---|
| 4,990,102 | A * | 2/1991 | Myers | H01R 13/58 439/452 |
| 5,647,757 | A | 7/1997 | Chrysostomou | |
| 7,445,471 | B1 * | 11/2008 | Scherer | H01R 13/506 439/108 |
| 8,900,010 | B2 * | 12/2014 | Aoki | H01R 4/185 439/587 |
| 9,142,895 | B2 * | 9/2015 | Hardy | H01R 9/0518 |
| 9,172,151 | B2 * | 10/2015 | Sato | H01R 4/206 |
| 2003/0060084 | A1 | 3/2003 | Aoki | |
| 2005/0227549 | A1 * | 10/2005 | Takayama | H01R 4/185 439/851 |

(Continued)

FOREIGN PATENT DOCUMENTS

| | | | |
|---|---|---|---|
| EP | 734100 | A2 | 5/2003 |
| WO | 2009064009 | A2 | 5/2009 |

*Primary Examiner* — Briggitte R Hammond

(74) *Attorney, Agent, or Firm* — Robert J. Myers

(57) ABSTRACT

An electrical connector system with adjusted impedance is described herein. The electrical connector system includes a cable having at least two conductors and a shell element provided at least partially around the cable. Further, the electrical connector system includes a connector housing assembly that is separate from the shell element and is configured to at least partially receive the two conductors and the shell element.

27 Claims, 4 Drawing Sheets

(56) References Cited

U.S. PATENT DOCUMENTS

| | | | | |
|---|---|---|---|---|
| 2005/0227550 | A1* | 10/2005 | Takayama | H01R 4/185 439/851 |
| 2011/0073365 | A1 | 3/2011 | Kuwayama et al. | |
| 2012/0202372 | A1* | 8/2012 | Hardy | H01R 9/0518 439/460 |
| 2012/0329318 | A1* | 12/2012 | Aoki | H01R 4/023 439/521 |

* cited by examiner

ELECTRICAL CONNECTOR WITH ADJUSTED IMPEDANCE

CROSS-REFERENCE TO RELATED APPLICATION

This application claims the benefit under 35 U.S.C. §119(a) of Patent Application No. 15177597.0 filed in the European Patent Office (EPO) on Jul. 21, 2015, the entire disclosure of which is hereby incorporated by reference.

TECHNICAL FIELD OF THE INVENTION

The present invention relates to an electrical connector system with adjusted impedance.

BACKGROUND OF THE INVENTION

Electrical connector systems are used to connect various cables, such as for example telecommunication cables, networking cables, other signaling cables or in general any electrical wiring. Electrical connector systems are used for joining electrical circuits, wherein typically a male-ended plug is configured to connect to a female-ended jack.

With increasing data rates, which are transferred via electrical connector systems, the requirements regarding the connection lines as well as the requirements regarding the electrical connector systems are increasing. Certain transmission systems have specific requirements for the associated transmission channel. Thereby the reflection performance of the transmission path is of particular relevance. As known in the art, impedance plays a major role in this respect: The variation of impedance along the transmission path may characterize the reflection performance of the transmission path.

For example, when a two-wire connection line is connected to a circuit board, impedance typically changes. The conductors of the connection line may be spaced further apart at the connection site for connecting them to, e.g., respective connection ports. As a result impedance increases. This, however, comes along with negative effects on the data transmission with high data rates.

Furthermore, in many applications the safe coupling of connectors is of high importance. It is thereby desired that connectors used for the connection of e.g. airbags to its ignition base of airbag systems in passenger cars do not become loose unintentionally. Therefore, secondary locking systems are used for guaranteeing a safe mechanical coupling.

The connection portion, where the cable may be dismantled and the conductors are connected to e.g. a contact terminal, can be particularly fragile. Thus, for protecting cable wiring connected to a contact terminal, electrical connector systems often require cable strain relief members, which relieve electrical connector systems from strains applied to a cable. However, there is still a need for improved techniques for protecting among others the connection area, i.e. where the cable is connected to a contact terminal, and for protecting the connection of the contact terminal linked to a corresponding counter connector.

The subject matter discussed in the background section should not be assumed to be prior art merely as a result of its mention in the background section. Similarly, a problem mentioned in the background section or associated with the subject matter of the background section should not be assumed to have been previously recognized in the prior art.

The subject matter in the background section merely represents different approaches, which in and of themselves may also be inventions.

BRIEF SUMMARY OF THE INVENTION

It is an object of the present invention to provide an electrical connector system which allows for transmitting data at high data rates with improved transmission characteristics, and in particular with low interference. It is a further object of the present invention to provide an electrical connector system which is simple to be mounted, provides a safe and secure coupling and optimized transmission characteristics. In particular, there is a need for a connector system providing improved transmission characteristics and an easy and safe connection.

According to one embodiment of the invention, an electrical connector system with adjusted impedance is provided. The electrical connector system includes a cable having at least two conductors, and a shell element provided at least partially around the cable. Preferably the cable includes a sheathing encompassing the at least two conductors, and the shell element is preferably provided on this cable sheathing.

The shell element of the electrical connector system is thereby provided such that it exerts a force on the cable to locally alter a distance between the at least two conductors. Thus, as the distance between the at least two conductors is locally altered, a compensation area with adjusted impedance may be generated. Preferably, the shell element is provided such that it exerts a force on the cable to locally shorten the distance between the at least two conductors. By reducing the distance between the conductors, the impedance is eventually reduced. Thus, the shell element is preferably provided such that it exerts the force on the cable to locally alter the distance between the at least two conductors for adjusting an impedance of the electrical connector system.

The electrical connector system further includes a connector housing assembly which is separate from the shell element and is configured to at least partially receive the at least two conductors and the shell element. The connector housing assembly may generally have any shape configured to connect to a corresponding counter connector. Further, the connector housing assembly may be constituted of one or more elements.

As described above, the impedance of an electrical connector system may be increased in a connection area, in which area the conductors are spaced further apart for coupling of the connectors to respective counterparts, for example. By locally reducing the distance between the at least two conductors locally inside the cable at a certain position in proximity to the connection area by means of the shell element, the excessive impedance at the connection area can be compensated, at least partially. The compensation area, i.e. the area in which the distance between the at least two conductors is locally altered by means of the shell element, acts compensatory on the electrical connector system by the effect of filtering. Although additional reflections in the high frequency range may thereby be generated, this is not problematic as these are not in the system-relevant area.

Preferably, the shell element includes an indentation. Preferably a major direction of this indentation is oriented parallel to a longitudinal direction of the cable. Thus, one can precisely set the force which is to be exerted on the cable by the shell element by providing a corresponding indentation on the shell element. The indentation locally acts on the cable to reposition the conductors therein. For example, if the shell element is a ring like element, the indentation can be provided on one side of the ring such that the two conductors inside the cable are pushed closer to each other. In another embodiment, the indentation can be provided such that the two conductors are pushed further apart from each other. Thereby, the impedance can be adjusted as desired, in particular in view of the impedance occurring at the connection area. The indentation may also be not straight, i.e. encircle the shell element at least partially. Preferably the indentation extends along substantially the entire (longitudinal) length of the shell element. Thus, it is the length of the shell element that has to be adjusted according to the desired impedance. As the length of the shell element itself can be controlled more easily than the length of an indentation provided thereon, the adjustment of the impedance by variation of the shell element length is more precise. The length of the shell element is preferably configured to the structure of the connector system. It will be appreciated that the force exerted by the shell element may vary along its length, such that particular impedance characteristics of the electrical connector system are set.

Preferably the shell element is crimped onto the cable. In another preferred embodiment, the shell element is a ferrule. As known in the art, a ferrule may be an object, generally used for fastening, joining, sealing or reinforcement. It may be a narrow circular rings made from metal or plastic. Thus, the person skilled in the art understands that a ferrule may be provided by known means, whereby the ferrule may for example include an indentation, for adjusting the force exerted on the cable in order to adjust the impedance.

The shell element may be of any suitable form and/or shape. It may fully or only partially envelope the cable to exert a force for obtaining the desired impedance characteristics. The shell element may be provided as clamping means which can be attached or clamped on the cable. The shell element may be implemented as a metal sleeve. If the shell element includes metal or preferably consists thereof, the advantageous compensation effect is reinforced such that only a reduced force may need be applied onto the conductors by the shell element. The shell element may be provided in two or more parts, which may be screwed together around the cable for exerting the force thereon, for example. The skilled person understands that the individual parts of a multi-part shell element may be interconnected to each other and/or attached to the cable by any suitable means.

Preferably the shell element is provided on an end portion of the cable. The end of the cable may be defined as the point at which a cable sheathing ends, or, at which the conductors end. The shell element may be provided exactly on the end of the cable, however, it will be acknowledged that the shell element may also be provided at a certain distance to the end of the cable, but still being in proximity to the end of the cable, i.e. being provided on the end portion of the cable. This end portion of the cable may extend 200 mm, preferably 100 mm, more preferably 70 mm, more preferably 50 mm and most preferably 30 mm from the end of the cable. The exact position of the shell element on the end portion of the cable depends largely on the frequency of the signal which is to be transmitted. Thus, the skilled person understands to provide the shell element on a suitable position on the end portion of the cable for achieving optimal transmission characteristics.

Preferably the shell element includes fixing means configured to fix the shell element with the cable, wherein the fixing means include a tooth-like projection in a further preferred embodiment. Accordingly, a strong fixation of the shell element to the cable can be provided, such that the desired impedance characteristics are maintained over time.

In a preferred embodiment the distance between the conductors of the cable may be different at a connection area of the connector system compared to an average distance within the cable aside the connection area and aside the compensation area or the shell element. The connection area may thereby be the site at which the conductors are electrically connected to a respective counterpart or port or the like. Preferably the inter-cable distance at the connection area is increased, such that a reliable connection can be provided with reduced risk of a bypass. The resulting impedance is preferably compensated by the shell element. Preferably the conductors may be connected to a contact terminal, which may include an insulation crimp and a wire crimp to connect to the conductors, and may further include an electrical interface for a corresponding counter connector.

Preferably the connector housing assembly includes a separate secondary lock member, which in turn preferably includes a fastening means for fastening the secondary lock member to the shell element, preferably for strain relief. Further the separate secondary lock member preferably includes integrated locking means configured for locking the secondary lock member directly to a corresponding counter connector. The term "counter connector" used herein denotes to any kind of connector configured to connect to the connector housing assembly. The counter connector and/or the component(s) of the connector housing assembly are preferably fabricated by injection molding.

Accordingly, the secondary lock member is not an integral part of the connector housing assembly. The secondary lock member is a single, separate member and is configured to transfer any cable strain, preferably directly, to the corresponding counter connector. Thus, any pull-out forces applied to the cable are transferred via the shell element and the secondary lock member to the counter connector, such that the wiring connection or connection area itself is advantageously not affected. The wiring connection has to withstand less force as the secondary lock member in connection with the shell element transfers the force to the counter connector. Furthermore, the present invention also advantageously relieves any primary locking means of the connector housing assembly connected to the counter connector. It is therefore also applicable in connector systems in which the connector housing assembly cannot be provided with an integrated primary lock, for example due to space limitations.

The secondary lock member is preferably shaped such that it can directly be fastened to the shell element and can directly be locked to the corresponding counter connector. Thus, the (longitudinal) length of the secondary lock member may be such that it extends to the shell element, which may be provided at a certain distance of the end of the cable depending on the desired transmission characteristics.

In a preferred embodiment, the shell element includes at least one protrusion configured to be in blocking contact with a respective recess of the secondary lock member. In another preferred embodiment the secondary look member includes at least one protrusion configured to be in blocking contact with a respective recess of the shell element. It will be appreciated that both the shell element and the secondary lock member may include both one or more protrusion and respective one or more recesses. By the interplay of the protrusion with the recess a strong grip between the shell element and the secondary lock member can be provided, such that any forces acting on the cable and/or the secondary lock member are efficiently transferred.

The shell element preferably provides at least two favorable functions: It firstly creates a compensation area with adjusted impedance for improving the transmission characteristics along the connector system. Secondly, it provides at the same time a means to which the secondary lock member can be fastened, thus allowing for secure cable strain relief.

A further advantage of providing the shell element is the effect of electromagnetic shielding, in particular if the shell element includes or consists of conductive and/or magnetic materials. Thereby an external electromagnetic field is blocked, or at least partially hindered from impacting on the cable covered by the shell element. It will be appreciated that an electromagnetic shielding may also be provided by a respective cable sheathing. The provision of the shell element further isolates the conductors from the environment.

Preferably, the connector housing assembly includes a connector housing, which may in turn include an aperture and which may be configured to receive the at least two conductors at least partially. Further preferred the shell element is not connected to the connector housing, preferably at least not directly. Thus, strain relief is provided for the connector housing. The housing itself may generally have any shape configured to connect to a corresponding counter connector. It may include means for locking to the corresponding counter connector and may be configured to receive a contact terminal which is connected to the at least two conductors.

In a preferred embodiment the secondary lock member includes mounting means for mounting the secondary lock member to the connector housing. Further preferred the mounting means includes at least one hook configured to envelope the connector housing at least partially when the secondary lock member is mounted thereto. In a particularly preferred embodiment the hook has a U-shaped cross-sectional profile. This mounting means allows for a simple assembly process and advantageously fixes the secondary lock member to the connector housing, thus improving stability of the entire system. Preferably, pull-out forces are transferred from the cable via the shell element and secondary lock member directly to the corresponding counter connector. If the secondary lock member is not locked to the counter connector, the pull-out forces act via the mounting means onto the connector housing, thus allowing for an extraction of the plug and eventually allowing for disconnecting the electrical connector system.

Preferably the electrical connector system further includes a counter connector including an aperture which is configured to receive the connector housing assembly at least partially therein. The person skilled in the art understands that the corresponding counter connector may be any connector that is compatible with the connector housing assembly. Preferably the corresponding counter connector is configured to interact with the respective means provided on the connector housing assembly in order to provide cable strain relief.

According to another embodiment of the invention a method of making an electrical connector system with adjusted impedance is also provided. The method includes the step of providing a cable including at least two conductors. The method further includes the step of providing a shell element at least partially around the cable such that it exerts a force on the cable to locally alter a distance between the at least two conductors. Preferably the shell element is provided such that it exerts a force on the cable to locally alter the distance between the at least two conductors for adjusting an impedance of the electrical connector system.

The shell element may be any shell element as described above, and is preferably a ferrule. Preferably this step includes a crimping of the shell element onto the cable.

The method further includes the step of providing a connector housing assembly configured to at least partially receive the at least two conductors and the shell element, and the step of connecting the at least two conductors and the shell element with the connector housing assembly.

It will be appreciated that the resulting electrical connector system may include any of the above described features, and that respective steps for making such may be performed.

BRIEF DESCRIPTION OF THE SEVERAL VIEWS OF THE DRAWING

The present invention will now be described, by way of example with reference to the accompanying drawings, in which.

DETAILED DESCRIPTION OF THE INVENTION

Figure 1:
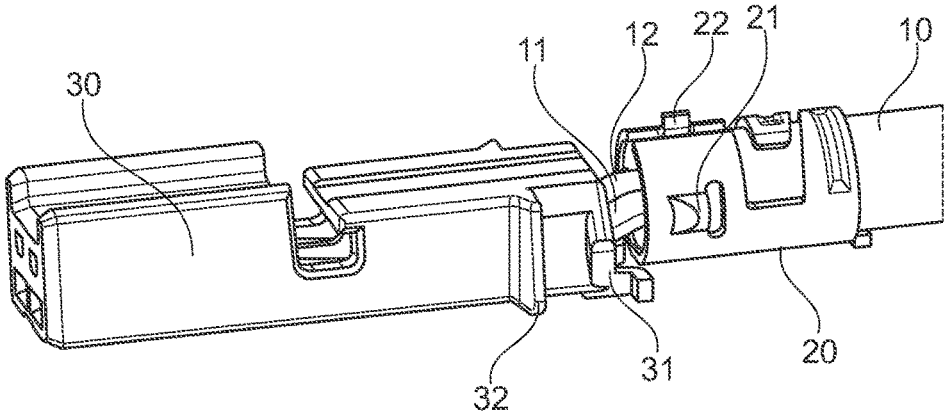
FIG. 1 illustrates an electrical connector system according to one embodiment.

FIG. 1 shows an electrical connector system according to one embodiment of the present invention. A cable 10 is provided, including two conductors 11, 12. The conductors 11, 12 may be copper wires, for example. The conductors 11, 12 may have a defined distance to each other if not altered as described below.

The conductors 11, 12 are connected to a connector housing 30, which may include a contact terminal inside (not shown). At the end of the cable 10 a shell element 20 or ferrule is provided. It encompasses the cable 10 such that a force is exerted on the two conductors 11, 12. As a result, the distance of the conductors 11, 12 may be shortened or increased locally in an area encompassed by the shell element 20. As illustrated, the shell element 20 is not necessarily of a completely closed form, but may encompass the cable 10 only partially.

The distance of the two conductors 11, 12 may be larger within the connector housing 30 compared to a site within cable 10 (not shown). Thus, impedance of the electrical connector system may increase due to the connection of the conductors 11, 12. However, since the distance of the two conductors 11, 12 may be locally shortened in an area inside the cable 10 encompassed by the shell element 20, this impedance is advantageously compensated. Thus, the electrical connector system of FIG. 1 features adjusted impedance for optimized transmission characteristics.

Figure 2:
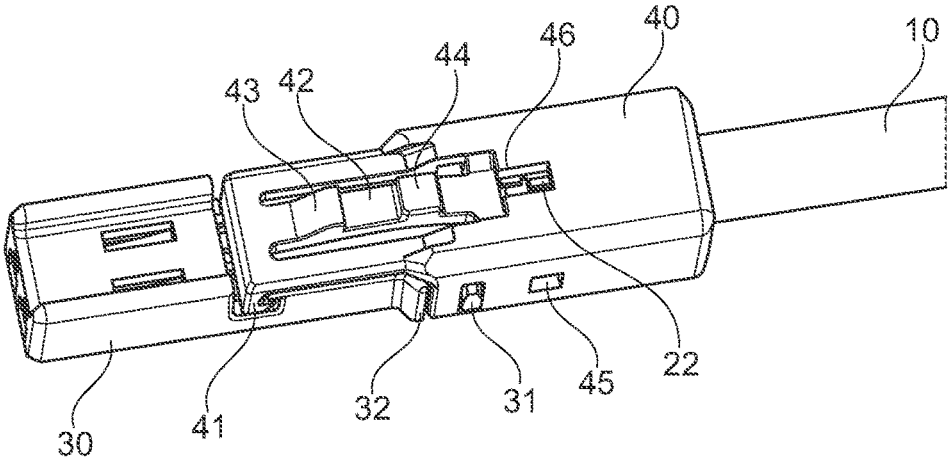
FIG. 2 illustrates an electrical connector system according to another embodiment.

The electrical connector system illustrated in FIG. 2 corresponds to that shown in FIG. 1, whereby the electrical connector system of FIG. 2 includes a separate secondary lock member 40. The secondary lock member 40 is primarily mounted to the connector housing 30 by means of a hook 41, which partially envelopes the connector housing 30. Furthermore, connector housing 30 includes securing means 31 for securing the secondary lock member 40 thereto. In addition, the secondary lock member 40 is connected to the shell element 20, and features an integrated flexible web 42 with a locking ramp 43 and an actuating member 44 in order to lock the secondary lock member 40 to a corresponding counter connector 50. The locking ramp 43 may function as integrated locking means in the sense of the present invention.

If the secondary lock member 40 is not locked to e.g. a counter connector 50, any pull-out forces applied to the cable 10 or secondary lock member 40 are transferred via the hook 41 and securing means 31 of the connector housing 30 to the connector housing 30. Further, any push-in forces are urging the secondary lock member 40 against a blocking face 32 of the connector housing 30. Thus, any fragile wiring within the connector housing 30 is protected.

The term "pull-out force" used herein denotes to any force that is acted so as to pull out a wire or cable from an electrical connector system. Analogous, the term "push-in force" used herein denotes to any force that is acted so as to push in a wire or cable into an electrical connector system.

As further depicted in FIG. 2, a protrusion 22 of the shell element 20 is placed within a recess 46 or window of the secondary lock member 40. Thus, any pull-out forces acting on the cable 10 are transferred to the secondary lock member 40 via the protrusion 22 being in contact with the recess 46.

Figure 3:
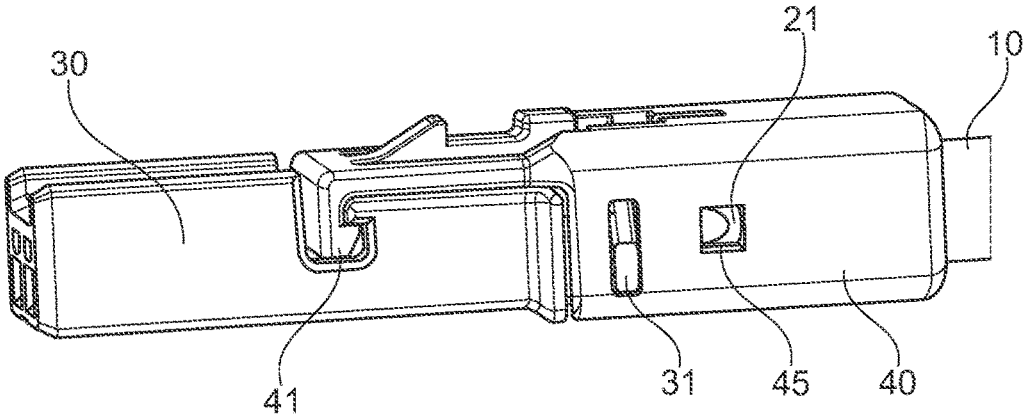
FIG. 3 shows the electrical connector system of FIG. 2 from another view.

FIG. 3 illustrates the electrical connector system of FIG. 2 in another view. Another protrusion 21 provided on the shell element 20 is in blocking contact with another opening 45 or recess 45 of the secondary lock member 40. Due to this blocking contact, a safe coupling of the secondary lock member 40 to the cable 10 is eventually achieved. Thus, any pull-out forces applied to the shell element 20 are transferred directly to the secondary lock member 40.

Figure 4:
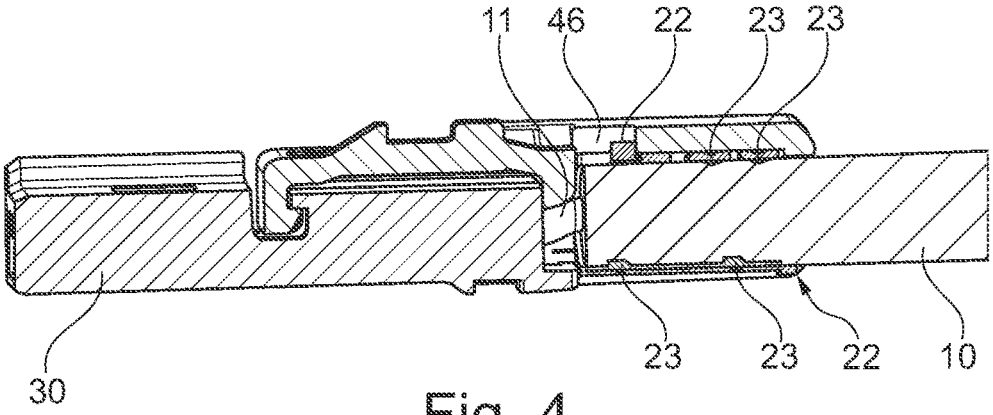
FIG. 4 shows the electrical connector system of FIG. 3 in a cross-sectional view.

FIG. 4 shows the electrical connector system of FIG. 3 in a cross-sectional view. The shell element 20 is fixed to the cable 10 by means of tooth-like projections 23. Thus, if pull-out forces are applied to cable 10, the forces are transferred via the tooth-like projections 23 to the shell element 20, and to the secondary lock member 40 via the protrusions 21, 22, each being in blocking contact with a respective recess 45, 46 of the secondary lock member 40. The wiring inside the connector housing 30 is not affected. The recesses may function as fastening means of the secondary lock member 40 for fastening the secondary lock member 40 to the shell element 20.

Figure 5:
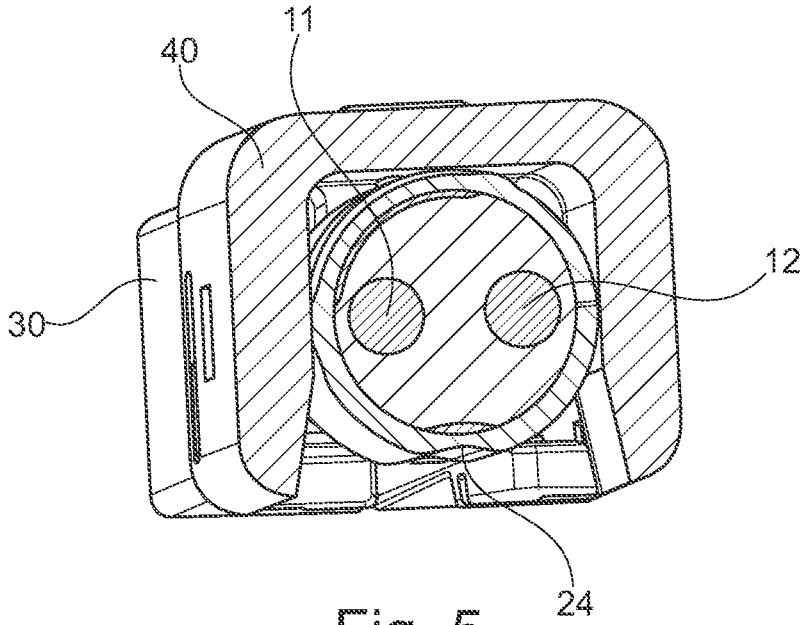
FIG. 5 shows the electrical connector system of FIG. 3 in a cross-sectional view.

FIG. 5 shows the electrical connector system of FIG. 3 in another cross-sectional view. An indentation 24 is provided on the shell element 20, causing the distance of the two conductors 11, 12 to alter in order to adjust impedance of the electrical connector system for improving the transmission characteristics. It will be appreciated that also a force provided by the secondary lock member 40 onto the shell element 20 may desirably alter the distance between the conductors 11, 12.

The form of the shell element 20 and in particular the indentation 24 are favorably such that a stable seating of the electrical connector system is provided. Due to the fixation of the shell element 20 to the secondary lock member 40, particularly provided by the interplay of the projections and recesses as described above, a rotation of the cable 10 around its longitudinal axis may be prevented. The indentation 24 thereby provides a strong seating of the conductors 11, 12 within the cable 10. Any forces, and particularly rotational forces, are transferred, preferably without slippage, via the shell element 20 and the secondary lock member 40 eventually to the counter connector 50. It will be appreciated that further or other means for proper and solid seating of the components may be provided. In particular, the secondary lock member 40 may be formed such that it holds on to the shell element 20 at the indentation 24.

Figure 6:
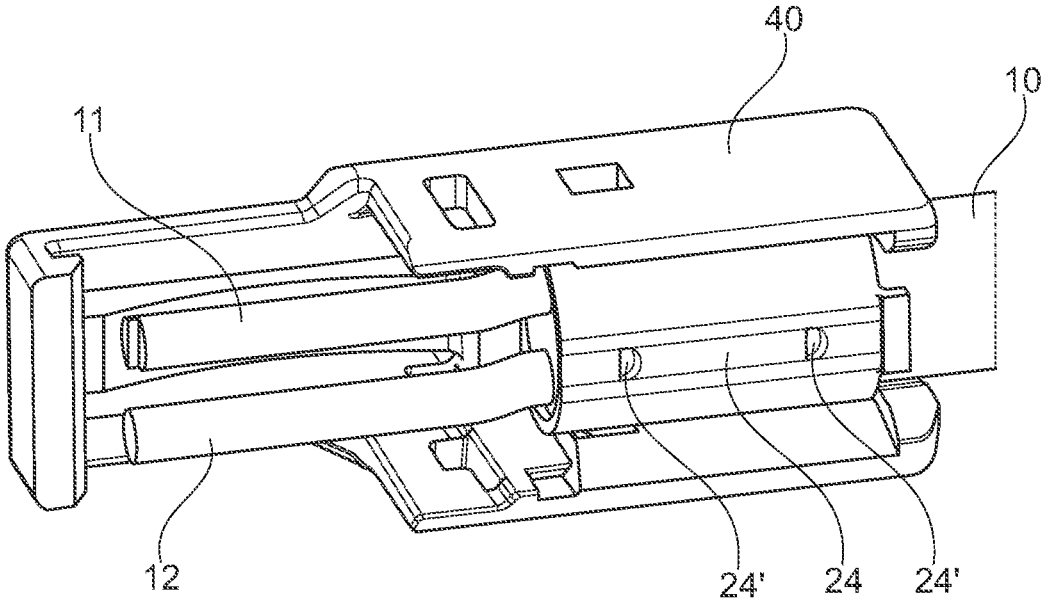
FIG. 6 shows an electrical connector system according to another embodiment.

The electrical connector system shown in FIG. 6 corresponds to that of FIG. 3, whereby the connector housing 30 is not shown. As can be seen, there are two protrusions 24' provided on the shell element 20 in order to fix the shell element 20 to the cable 10. The protrusions 24' are provided in the indentation 24, such that a better fixation of the shell element 20 is eventually achieved.

Figure 7:
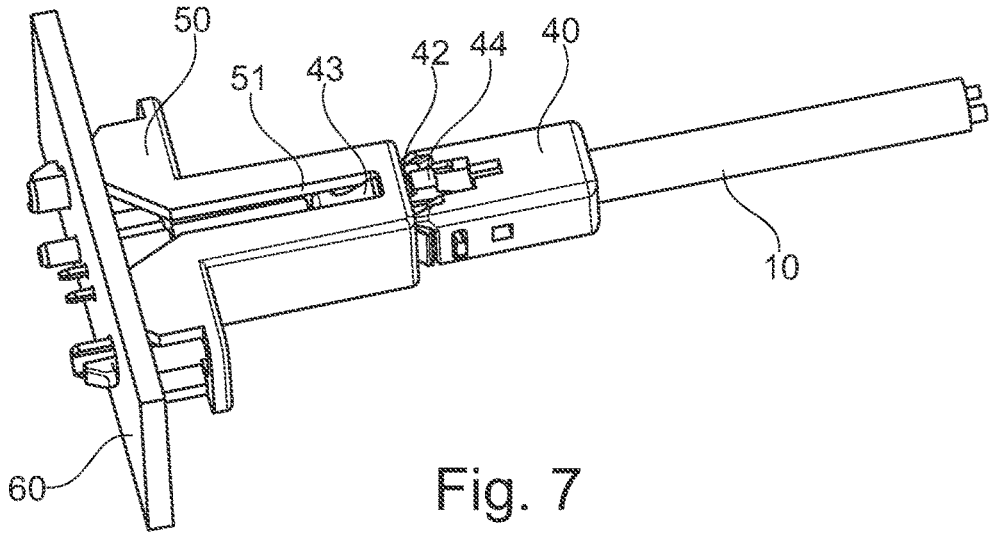
FIG. 7 shows an electrical connector system according to a further embodiment.

FIG. 7 shows the electrical connector system of FIG. 3 connected to a corresponding counter connector 50, which in turn is connected to e.g. a panel 60. Upon inserting the electrical connector system of FIG. 3 into the counter connector 50, the flexible web 42 is lowered, as the locking ramp 43 is in sliding contact with the counter connector 50. As soon as the locking ramp 43 is located fully within the window 51 of the counter connector 50, the flexible web 42 snaps back such that the locking ramp 43 is providing a locking function. In order to release the connection, an operator may lower the flexible web 42 by pressing on actuating member 44, such that the locking contact between locking ramp 43 and window 51 is cancelled.

Figure 8:
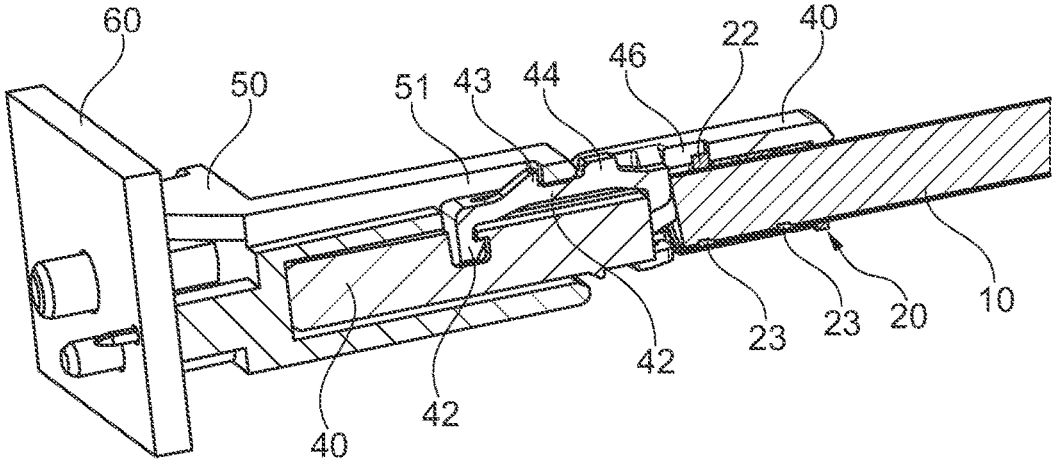
FIG. 8 shows the electrical connector system of FIG. 7 in a cross-sectional view.

FIG. 8 shows the electrical connector system of FIG. 7 in a cross-sectional view. When a pull-out force is applied to cable 10, this force is transferred the following way: Via the tooth-like projections 23 to the shell element 20, via the protrusion 22 being in blocking contact with recess 46 to the secondary lock member 40, and via the locking contact of the locking ramp 43 to the counter connector 50 and eventually to panel 60. Thereby, a reduced or preferably no force is acting on the wiring inside the connector housing 30. Further, as the shell element 20 is locally altering the distance of the conductors 11, 12 within cable 10, the impedance created due to the wiring inside the connector housing 30 is compensated such that optimized transmission characteristics are achieved.

The terms "fastening", "locking", "mounting" and so forth used herein in connection with different means do not imply a particular application method, but are merely used to label the different means for clarification. Accordingly, mounting means may generally provide locking functions, for example, and locking means may be used for mounting.

While this invention has been described in terms of the preferred embodiments thereof, it is not intended to be so limited, but rather only to the extent set forth in the claims that follow. Moreover, the use of the terms first, second, primary secondary, etc. does not denote any order of importance, but rather the terms first, second, etc. are used to distinguish one element from another. Furthermore, the use of the terms a, an, etc. do not denote a limitation of quantity, but rather denote the presence of at least one of the referenced items.

We claim:

1. An electrical connector system with adjusted impedance, comprising:

a cable having only two solid copper wires separated from one another;

a shell element provided at least partially around said cable; and a connector housing assembly separate from the shell element and configured to at least partially receive the two solid copper wires and the shell element, wherein the shell element is provided such that it exerts a force on the cable to locally alter a distance between the two solid copper wires, and wherein the shell element comprises fixing means configured to fix the shell element to the cable, wherein said fixing means comprises a tooth-like projection.

2. An electrical connector system with adjusted impedance, comprising:

a cable having only two solid copper wires separated from one another;

a shell element provided at least partially around said cable; and a connector housing assembly separate from the shell element and configured to at least partially receive the two solid copper wires and the shell element, wherein the shell element is provided such that it exerts a force on the cable to locally alter a distance between the two solid copper wires, wherein the connector housing assembly comprises a separate secondary lock member, and wherein the secondary lock member comprises fastening means for fastening the secondary lock member to the shell element and integrated locking means configured for locking the secondary lock member directly to a corresponding counter connector.

3. An electrical connector system with adjusted impedance, comprising:

a cable having at least two conductors;

a shell element provided at least partially around said cable; and a connector housing assembly separate from the shell element and configured to at least partially receive the at least two conductors and the shell element, wherein the shell element is provided such that it exerts a force on the cable to locally alter a distance between the at least two conductors, wherein the shell element comprises fixing means configured to fix the shell element to the cable, wherein said fixing means comprises a tooth-like projection.

4. The electrical connector system in accordance with claim 3, wherein the shell element comprises an indentation.

5. The electrical connector system in accordance with claim 4, wherein a major direction of the indentation is oriented parallel to a longitudinal direction of the cable.

6. The electrical connector system in accordance with claim 4, wherein the indentation extends along substantially an entire length of the shell element.

7. The electrical connector system in accordance with claim 3, wherein the shell element is crimped onto said cable.

8. The electrical connector system in accordance with claim 3, wherein the shell element is a ferrule.

9. The electrical connector system in accordance with claim 3, wherein the shell element is provided on an end portion of the cable.

10. The electrical connector system in accordance with claim 3, wherein the cable comprises a sheathing encompassing the at least two conductors, and wherein the shell element is provided on said sheathing.

11. The electrical connector system in accordance with claim 3, wherein the shell element is provided such that it exerts the force on the cable to locally shorten the distance between the at least two conductors.

12. The electrical connector system in accordance with claim 3, wherein the shell element is provided such that it exerts the force on the cable to locally alter the distance between the at least two conductors for adjusting an impedance of the electrical connector system.

13. The electrical connector system in accordance with claim 3, further comprising a counter connector comprising an aperture configured to receive the connector housing assembly at least partially therein.

14. An electrical connector system with adjusted impedance, comprising:

a cable having at least two conductors;

a shell element provided at least partially around said cable; and a connector housing assembly separate from the shell element and configured to at least partially receive the at least two conductors and the shell element, wherein the shell element is provided such that it exerts a force on the cable to locally alter a distance between the at least two conductors, wherein the connector housing assembly comprises a separate secondary lock member, wherein the secondary lock member comprises fastening means for fastening the secondary lock member to the shell element and integrated locking means configured for locking the secondary lock member directly to a corresponding counter connector.

15. The electrical connector system in accordance with claim 14, wherein the shell element comprises at least one protrusion configured to be in blocking contact with a respective recess of the secondary lock member and wherein the secondary lock member comprises at least one protrusion configured to be in blocking contact with a respective recess of the shell element.

16. The electrical connector system in accordance with claim 14, wherein the connector housing assembly comprises a connector housing configured to receive the at least two conductors at least partially, and wherein the shell element is not connected to the connector housing.

17. The electrical connector system in accordance with claim 16, wherein the secondary lock member comprises mounting means for mounting the secondary lock member to the connector housing, wherein the mounting means comprise at least one hook configured to envelope the connector housing at least partially when the secondary lock member is mounted thereto.

18. The electrical connector system in accordance with claim 14, wherein the shell element comprises an indentation.

19. The electrical connector system in accordance with claim 18, wherein a major direction of the indentation is oriented parallel to a longitudinal direction of the cable.

20. The electrical connector system in accordance with claim 18, wherein the indentation extends along substantially an entire length of the shell element.

21. The electrical connector system in accordance with claim 14, wherein the shell element is crimped onto said cable.

22. The electrical connector system in accordance with claim 14, wherein the shell element is a ferrule.

23. The electrical connector system in accordance with claim 14, wherein the shell element is provided on an end portion of the cable.

24. The electrical connector system in accordance with claim 14, wherein the cable comprises a sheathing encompassing the at least two conductors, and wherein the shell element is provided on said sheathing.

25. The electrical connector system in accordance with claim 14, wherein the shell element is provided such that it exerts the force on the cable to locally shorten the distance between the at least two conductors.

26. The electrical connector system in accordance with claim 14, wherein the shell element is provided such that it exerts the force on the cable to locally alter the distance between the at least two conductors for adjusting an impedance of the electrical connector system.

27. The electrical connector system in accordance with claim 14, further comprising a counter connector comprising an aperture configured to receive the connector housing assembly at least partially therein.

* * * * *